US006371321B1

(12) United States Patent
Lee

(10) Patent No.: US 6,371,321 B1
(45) Date of Patent: Apr. 16, 2002

(54) CASE MODULE FOR ARTICLES

(76) Inventor: Ching-Chuan Lee, No. 9, Lane 50, Sec. 3, Muhsin Road, Taipei (TW)

( * ) Notice: Subject to any disclaimer, the term of this patent is extended or adjusted under 35 U.S.C. 154(b) by 0 days.

(21) Appl. No.: 09/867,404

(22) Filed: May 31, 2001

(30) Foreign Application Priority Data

Apr. 23, 2000 (TW) ..... 89218273A01 U
Oct. 21, 2000 (TW) ..... 89218273 U

(51) Int. Cl.[7] ..... B65D 21/02
(52) U.S. Cl. ..... 220/23.4; 220/23.6
(58) Field of Search ..... 220/23.4, 23.6, 220/23.2, 4.02

(56) References Cited

U.S. PATENT DOCUMENTS 4,216,857 A * 8/1980 Huang ..... 220/23.4
4,583,640 A * 4/1986 Gillam ..... 220/23.4
4,624,383 A * 11/1986 Moore ..... 220/23.4
5,050,755 A * 9/1991 Strander ..... 220/23.4
5,105,962 A * 4/1992 Gotz ..... 220/23.4
5,159,156 A * 10/1992 Munk et al. ..... 220/23.4

* cited by examiner

*Primary Examiner*—J. Moy
(74) *Attorney, Agent, or Firm*—Troxell Law Office PLLC

(57) ABSTRACT

A case module for articles comprises an open top case chamber confined by a front wall, a rear wall, a left wall, a right wall, and a bottom wall, a front part disposed in front of the font wall, a rear part disposed in front of the rear wall, and a flat upper lid. The characteristics is in that the case module can be lifted in a state of opening by way of two lid projections on the upper lid being inserted between a beam groove in the rear part and the case chamber and the support device being inserted into the lid cover. Moreover, a right and left connection of the case modules can be performed by that the wall frame on the left wall of the one case module being inserted into the wall recess on the right wall of the another case module. A front and rear connection of the case modules can be performed by that a rear stick on the one case module is inserted into a front post of the another case module.

11 Claims, 11 Drawing Sheets

CASE MODULE FOR ARTICLES

BACKGROUND OF THE INVENTION

1. Field of the Invention

The present invention relates to a case module for articles, and particularly to a case module, which not only is feasible for joining with other case modules right and left and front and rear but also has an upper lid possible to spring up in case of being apart from the case module.

2. Description of Related Art

It has been years that a case with a lifted lid is utilized for containing articles and the case provides a function of receiving and reserving articles regardless that the case is portable or stationary.

There are a variety of articles with different properties possible to be received in one or more cases such that it is necessary to offer different kinds of cases for the articles. Some of the cases such as a tool box, a parts box, . . . , and so on offer a function of being opened at any time as desired.

Besides, many electronic components such as resistors, capacitors, integrated circuits (IC), interface cards, . . . , and so on are getting multiplicity due to the rise of electronic industry. A specific feature of these components is that they are classified particularly and they have a very small size each. Meanwhile, it is much flexible while the electronic components are used so that it is hard for the traditional case to cope with a fast change with regard to receiving, storing, or carrying them. Hence, it is necessary to have a case with more practicality in order to solve the bottleneck.

Furthermore, an ordinary case is required to have an assistance of elastic component such as a spring in order to obtain a lift of the lid thereof with a big angular movement. However, it is unfavorable that the elastic component gets involved in the difficulty of the assembling job and an increase of the production cost.

SUMMARY OF THE INVENTION

An object of the present invention is to develop a case module for articles, which can be in conjunction with other case modules front and rear, and right and left so as to receive different articles in addition to the preceding electronic components.

BRIEF DESCRIPTION OF THE DRAWINGS

The present invention can be more fully understood by referencing to the following description and accompanying drawings, in which.

DETAILED DESCRIPTION OF THE PREFERRED EMBODIMENTS

Figure 1:
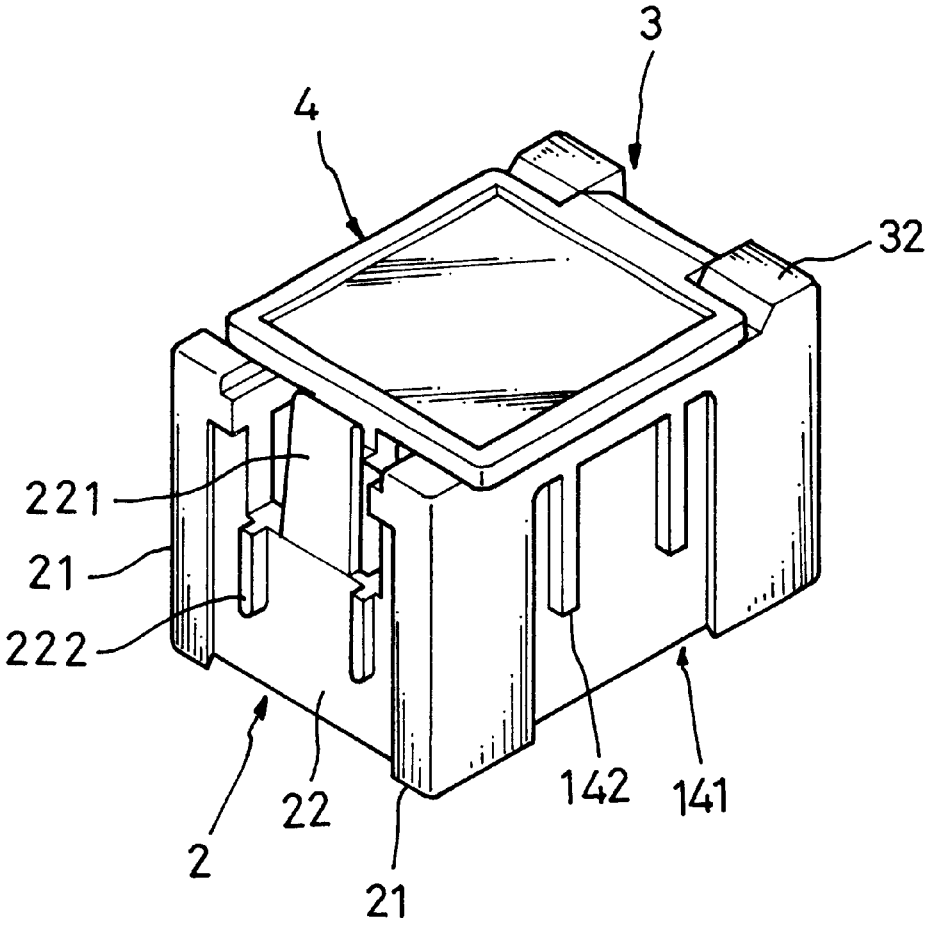
FIG. 1 is a perspective view of a case module for articles according to the present invention in an embodiment thereof.
Figure 2:
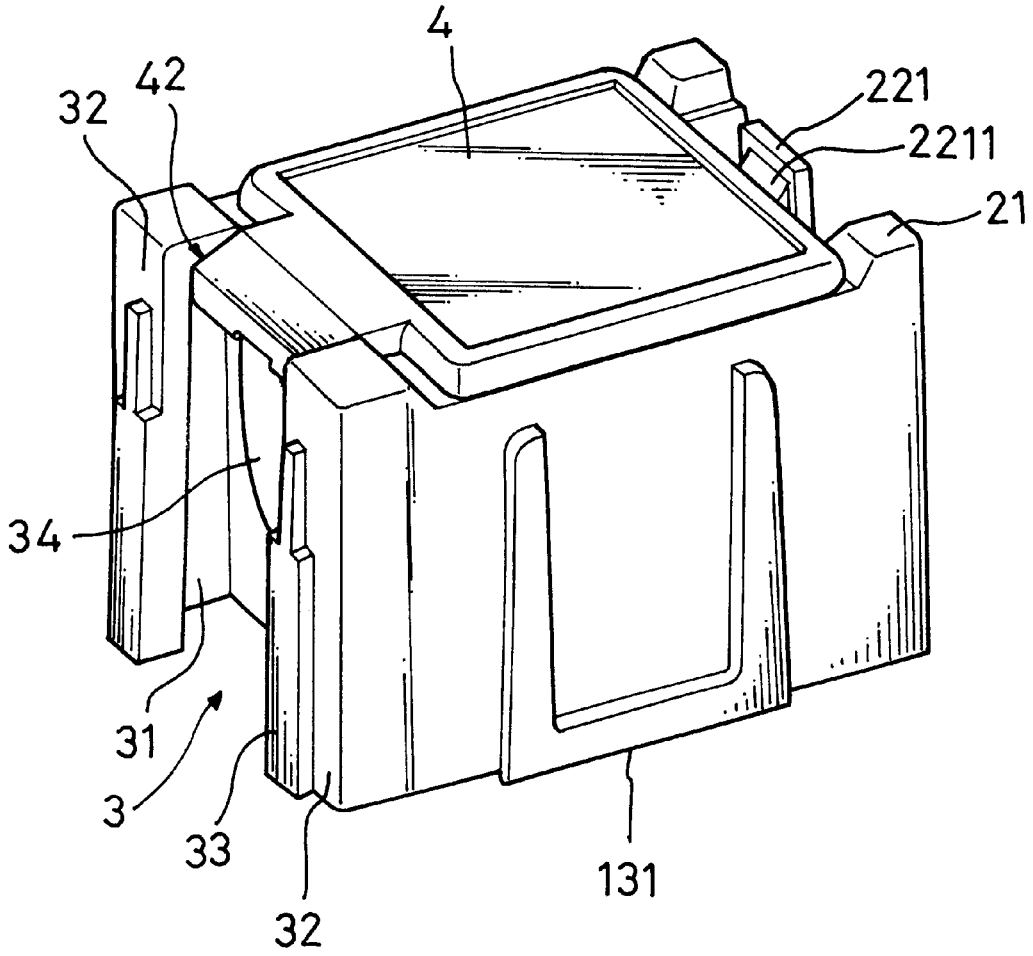
FIG. 2 is a perspective view similar to FIG. 1 with a projection angle different from that shown in FIG. 1.
Figure 3:
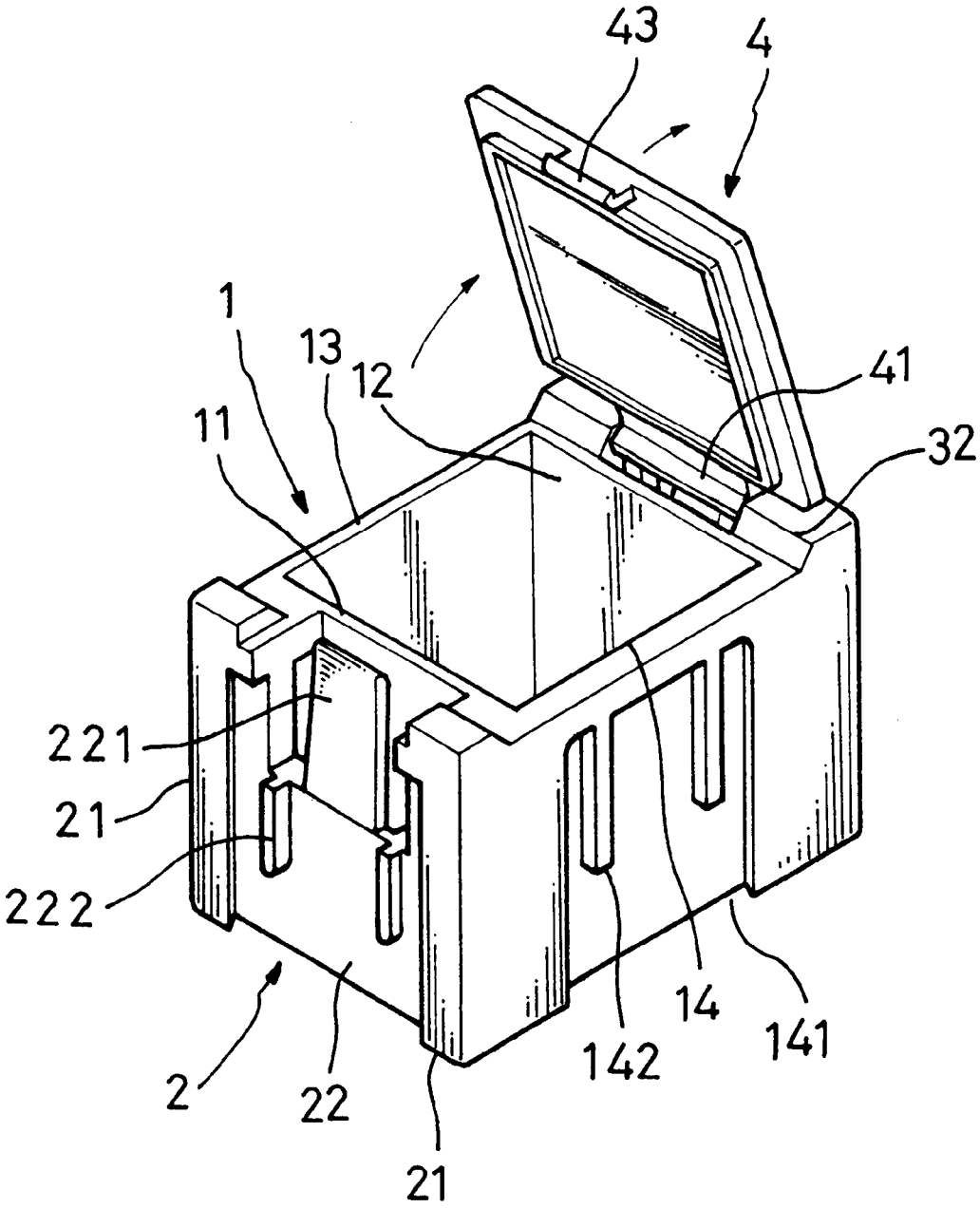
FIG. 3 is a perspective view illustrating an upper lid on the case module for articles of the embodiment being in a state of opening.
Figure 4:
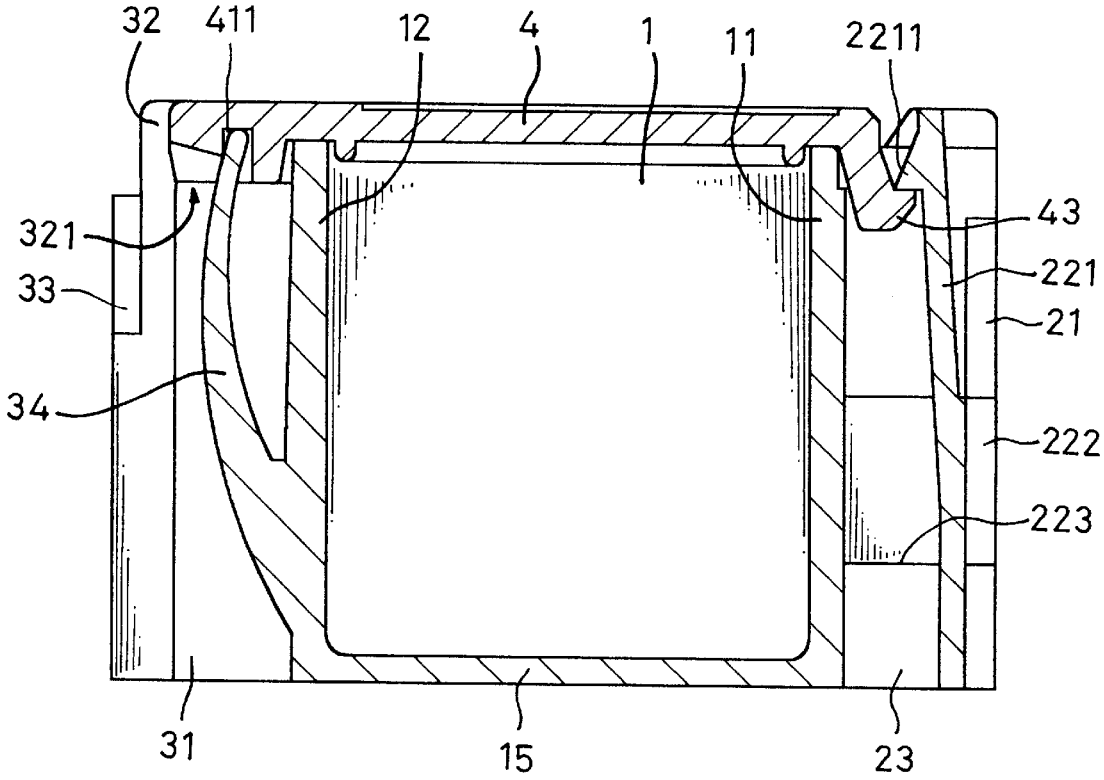
FIG. 4 is a side sectional view of the case module of the present invention in the embodiment thereof.
Figure 5:
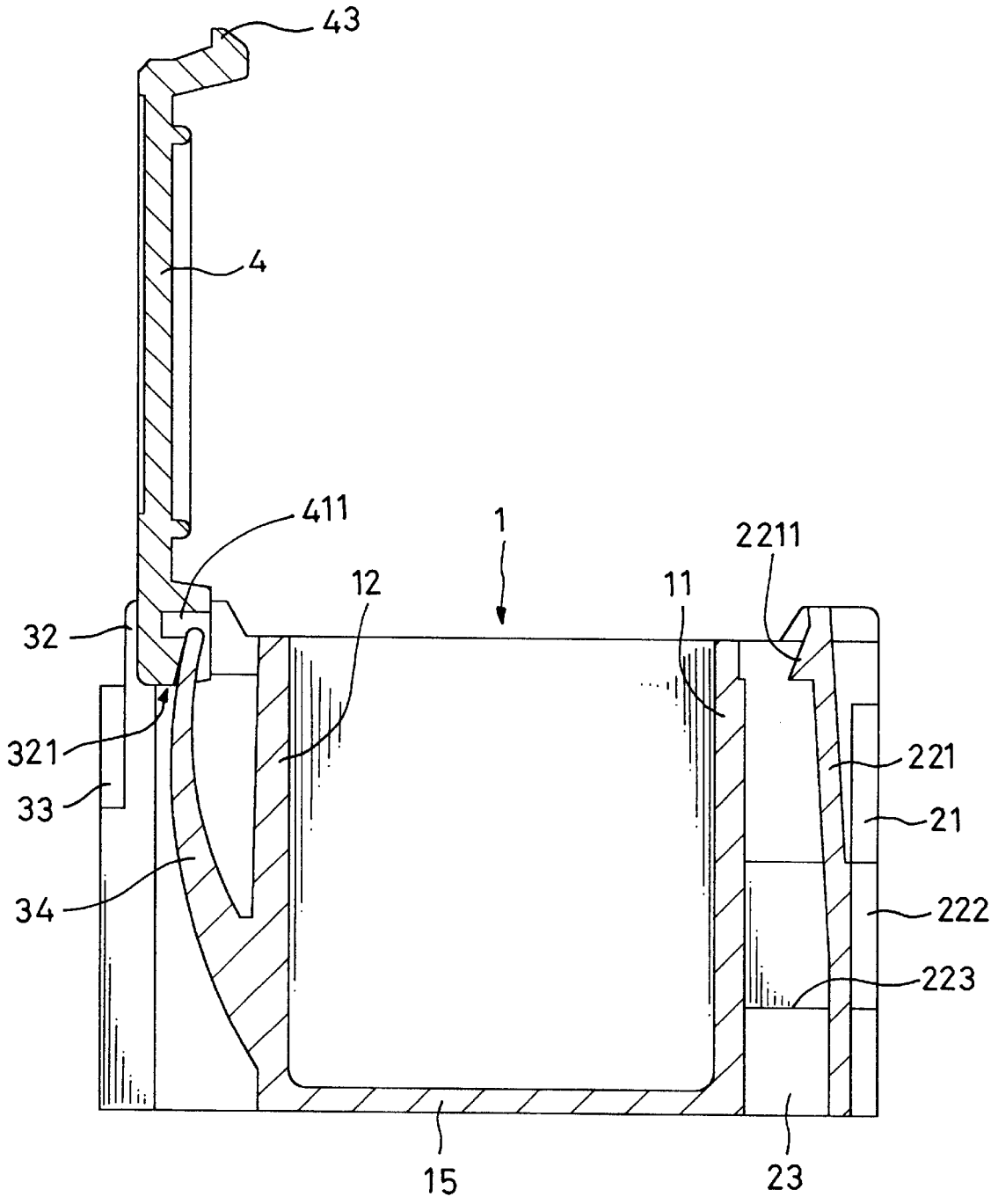
FIG. 5 is a side sectional view of the case module of the embodiment in a state of the upper lid being in a state of opening.
Figure 6:
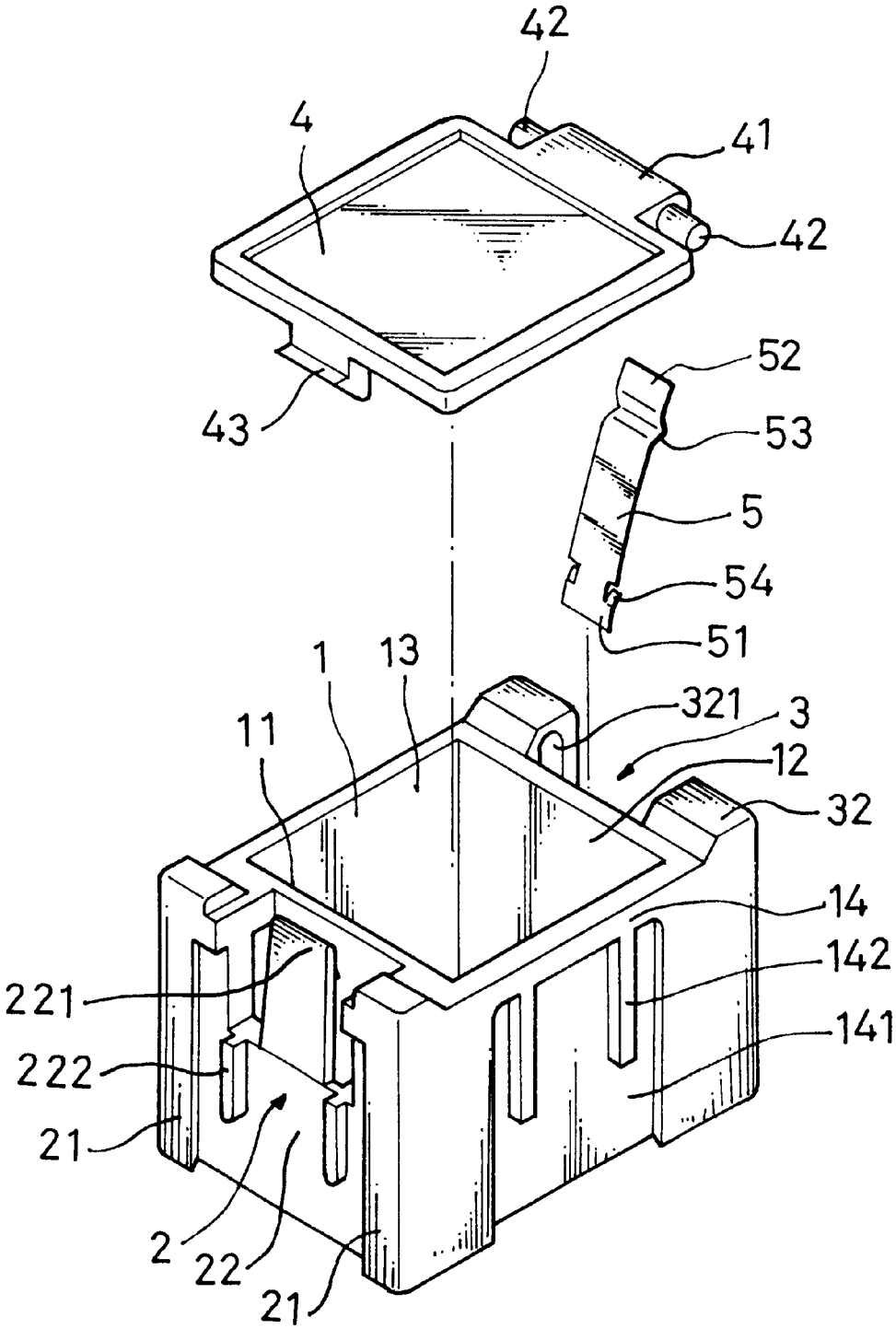
FIG. 6 is an exploded perspective view of a case module according to the present invention in another embodiment thereof.
Figure 7:
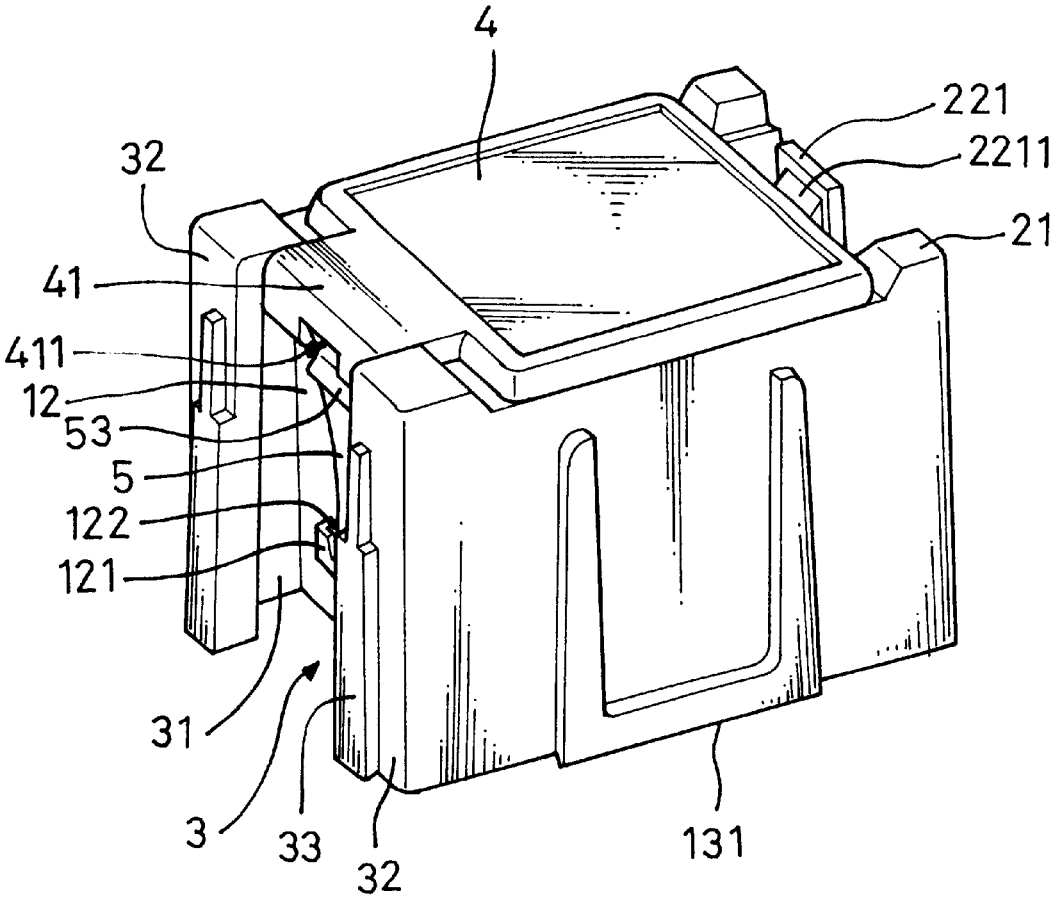
FIG. 7 is an assembled perspective view of the case module shown in FIG. 6.
Figure 8:
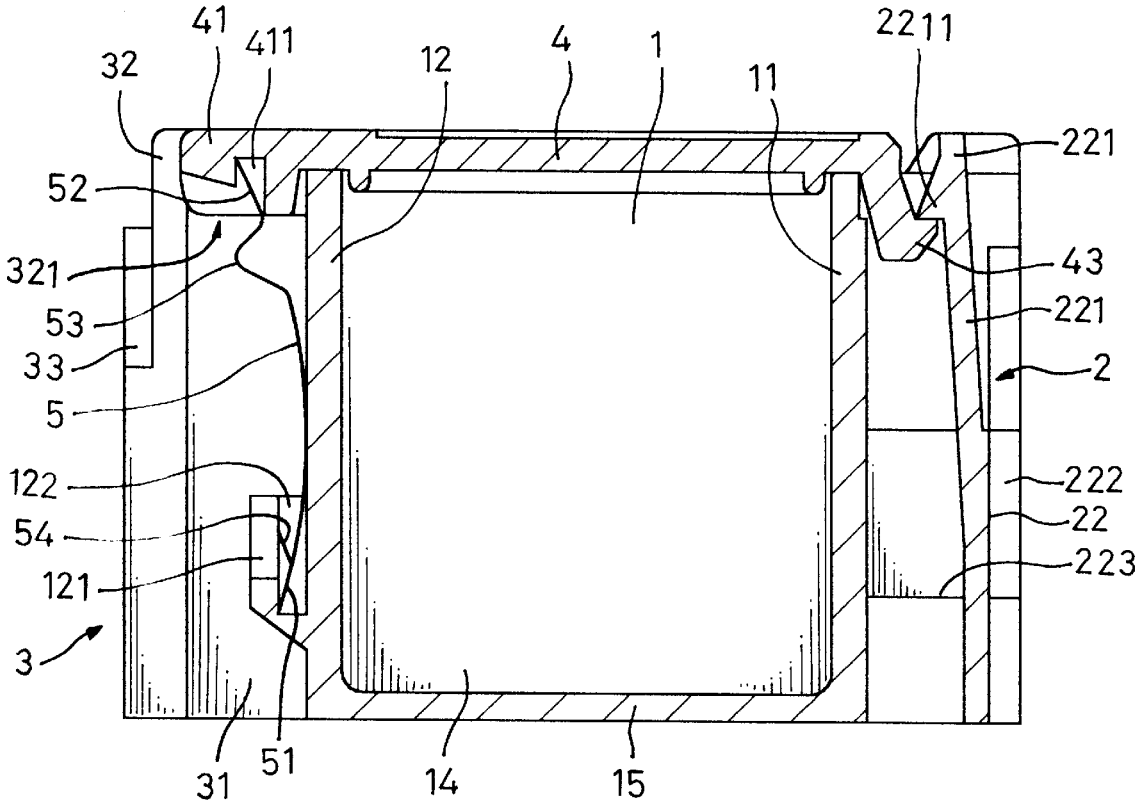
FIG. 8 is a side sectional view of the case module in another embodiment shown in FIG. 6.
Figure 9:
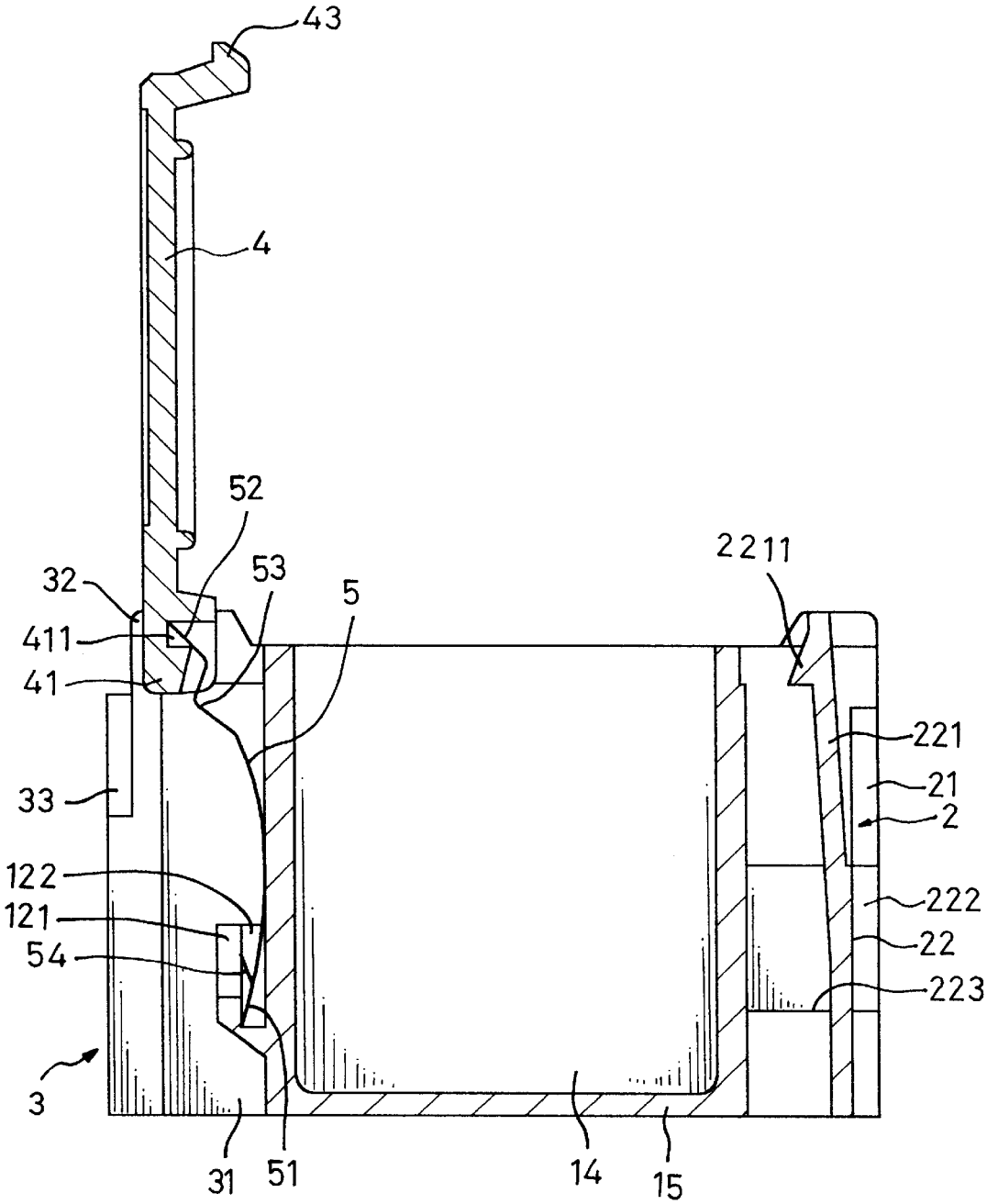
FIG. 9 is a side sectional view illustrating the case module of another embodiment showing the upper lid in a state of opening.

Referring to FIGS. 1, 2, 3, 4, and 5, a case module of the present invention basically comprises a case chamber 1, a front part 2, a rear part 3, and an upper lid.

Wherein, the case chamber 1 (shown in FIG. 3) is a space confined by a front wall 11, a rear wall 12, a left wall 13, a right wall, and a bottom wall 15 (shown in FIG. 4) with an opening top for receiving articles. The case module preferably provides a square shape, but it is fine if a rectangular shape is arranged for the case module.

The case chamber 1 at the front Wall 11 thereof can be integrally associated with the front part 2, and at the rear wall 12 thereof can be integrally associated with the rear part 3 as well. In the mean time, the left wall 13 at the outer surface thereof protrudes outward a U-shaped wall frame 131 with an upper opening and a slant cut is formed between both lateral upright frame part of the wall frame 131 and the left wall 13.

The right wall 14 of the case chamber 1 provides a U-shaped wall recess 141 at the outer surface thereof (shown in FIG. 1) corresponding to the wall frame 131 and a width of the wall recess 141 is corresponding to that of the wall frame 131 so as to fit with each other. The wall recess 141 at the upright part thereof inclines outward with a slope corresponding to the slant cut of the wall frame 131 such that the wall frame 131 and the wall recess 141 may engage with each other without slipping off. The wall recess 141 at both lateral sides thereof provides an elongated projection 142 respectively and a distance between the elongated projection 142 and an outer surface of the wall recess 141 corresponds to the width of the wall frame 131 so as to regulate a uniform positioning after engagement. In practice, the positions of the left wall 13 and the right wall 14 can be disposed to change each other, and because this is a conventional art, no detail will be described further.

The front part 2 is arranged to be integral with the outer side of the front wall 11 of the case chamber 1 and both lateral sides of the front part 2 extends a front post 21 respectively. Each front post 21 at the top thereof extends inward to join a front plate 22 so as to form a drop between them. Meanwhile, a front through hole 23 (shown in FIG. 4) with a rectangular cross section is formed between the front plate 22 and the front wall 11. An upper end of the front plate 22 at both lateral sides thereof is cut off to constitute an upward engaging plate 221 and the lower part of the engaging plate 221 at both lateral sides thereof has a front projection 222 respectively such that a distance between the front projection 222 and the front post 21 corresponds to the width of a rear post 31. In order to offer a firm engagement, the engaging plate 221 at the top thereof may be provided with a lock pawl 2221 extending toward the inner side of the front wall 11. In addition, in order to intensify the strength of the front plate 22, two front ribs 223 can be arranged to join the front plate 22 and the front wall 11.

The rear part 3 extends integrally from the rear wall 12 and the rear part 3 at both outer sides thereof has the rear post 31 respectively to extend vertically a section of rear beam 32. The rear beam 32 at the bottom thereof has a section of upward rear stick 33 and a slant cut is formed between the outer side of the rear stick 33 and the rear beam 32 and a width of slant cut corresponding to a distance between the two front posts 21 for being able to engage with each other. Besides, the rear beam 32 at the top thereof has an inner beam groove 321 for fitting with the upper lid 4. In the meantime, the rear wall 12 on the wall surface thereof provides a support device extending upward and inclining outward from the lower part thereof, such as the rear wall 12 extending integrally a slant plate 34, to move with respect to the upper lid 4. In fact, the rear part 3 is arranged to correspond to the front part 2 for being able to engage with each other so that the position of the rear part 3 can be changed to that of the front part 2. But, this is a conventional art so that no details will be described further.

The upper lid 4 is flat cover with a size thereof corresponding to the case chamber 1 and the rear side thereof extends a central lid plate 41 and a lid projection 42 toward both lateral sides thereof respectively. The lid projection 42 has an outer diameter corresponding to the beam groove 321 such that the lid projection 42 can be rotatably inserted into the beam groove 321. The lid plate 41 at the center thereof provides a lid groove 411 to be pressed tightly by the slant plate 34 elastically. The lid groove 411 provides a bend to offer a function of position retaining during being opened or closed. In addition, the upper lid at the front side thereof extends a lid hook 43 corresponding to the engaging plate 221 for being able to engage with each other.

Referring to FIGS. 1 to 5 again, the lid projection 42 may urge the slant plate 34 to insert into the beam groove 321 while in use such that the upper lid 4 can be in a state of rotating. Further, the slant plate 34 is inserted into the lid groove 411 to form a tight fit. Meanwhile, the lid hook 43 is to engage with the engaging plate 221 and the case module can form a state of closing to allow the case chamber 1 containing articles safely. The front plate 22 can be stirred outward to release the engaging plate 221 from the lid hook 43 such that the upper lid 4 can spring and turn upward to allow the upper lid being lifted in a state opening due to the elastic force of the slant plate 34.

In case of the case module of the present invention at the left and the right sides thereof being intended to join with other identical ones in series, the wall frame 131 at the left wall 13 thereof can be inserted into the right wall 14 of another case module so that the wall recess 141 and the left wall 13 can be in conjunction with the right wall 14 by way of the slant cuts on the both walls respectively engaging with each other and the confinement between the wall projection 142 and the wall frame 131.

In case of the case module of the present invention at the front and the rear sides thereof being joined with other identical ones in series, the rear stick 33 is inserted into the front post 21 from the bottom thereof and an engagement can be conducted by way of a slant cut on the rear stick 33 and the front post 21 respectively corresponding to each other and the front projection 222 confining the rear post 31.

Referring to FIGS. 6 to 9, another embodiment is illustrated and the parts thereof, which are identical with those in the preceding embodiment, are expressed by the same designations and numerals for simplifying the description. The only difference between the present embodiment and the preceding embodiment is that the support device arranged in the present embodiment is a projection plate 5 instead of the slant plate 34 in the preceding embodiment. Hence, the rear wall 12 at the outer surface thereof has a wall seat 121 and forms an engaging groove 122. The projection plate 5 provides a plate end 51 to be inserted into the engaging groove 122 such that the projection plate 5 extends in a way of inclining upward and the other end thereof is an insert end 52 and a bend 53. The insert end 52 is inserted into and tightly fit with the lid groove 411 elastically. When the upper lid is lifted, the bend part 53 presses against the lid plate 41 to avoid the upper lid from an excess lift. Besides, in order to enhance the projection plate 5 in conjunction with the engaging groove 122, the plate end at both sides thereof has an end flap 54 to keep the projection plate 5 off disengaging from the engaging groove 122.

Referring to FIGS. 5 to 9 again, while the present embodiment is in use, the upper lid 4 with the lid projection 42 presses and passes over the projection plate 5 so as to enter the beam groove 321 such that the projection plate 5 can be in a state of rotating. The insert end 52 is inserted into and presses against the lid groove 411. In the meantime, the lid hook 43 engages with the engaging plate 221 to form a state of closing so that the case chamber 1 can contain articles safely. As soon as the upper lid is going to be opened, the front plate 22 is stirred outward to disengage the engaging plate 22 from the lid hook 43 such that the upper lid 4 can spring upward and turn to be in a state of opening.

Figure 10:
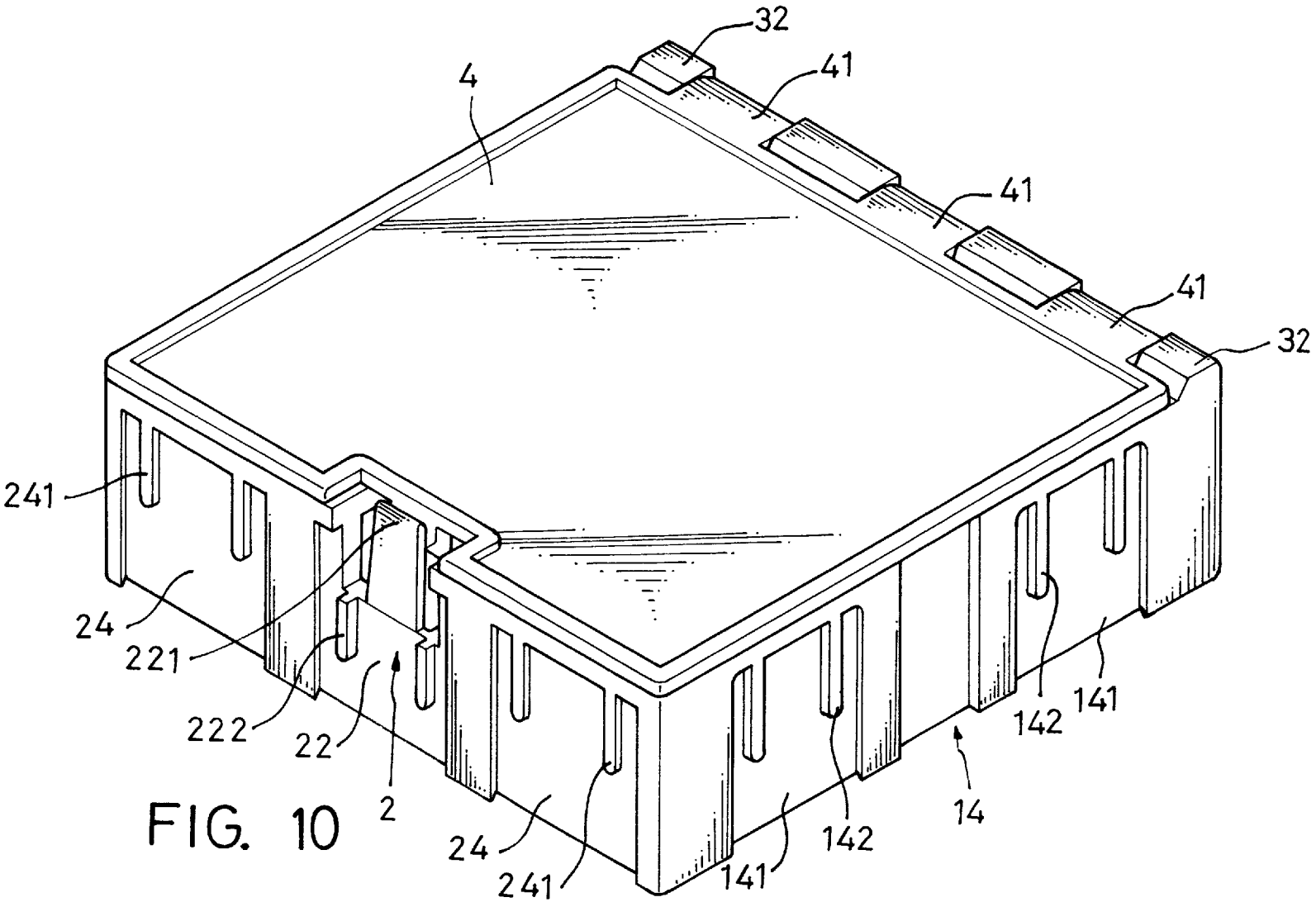
FIG. 10 is a front perspective view of the present invention in a further embodiment thereof.
Figure 11:
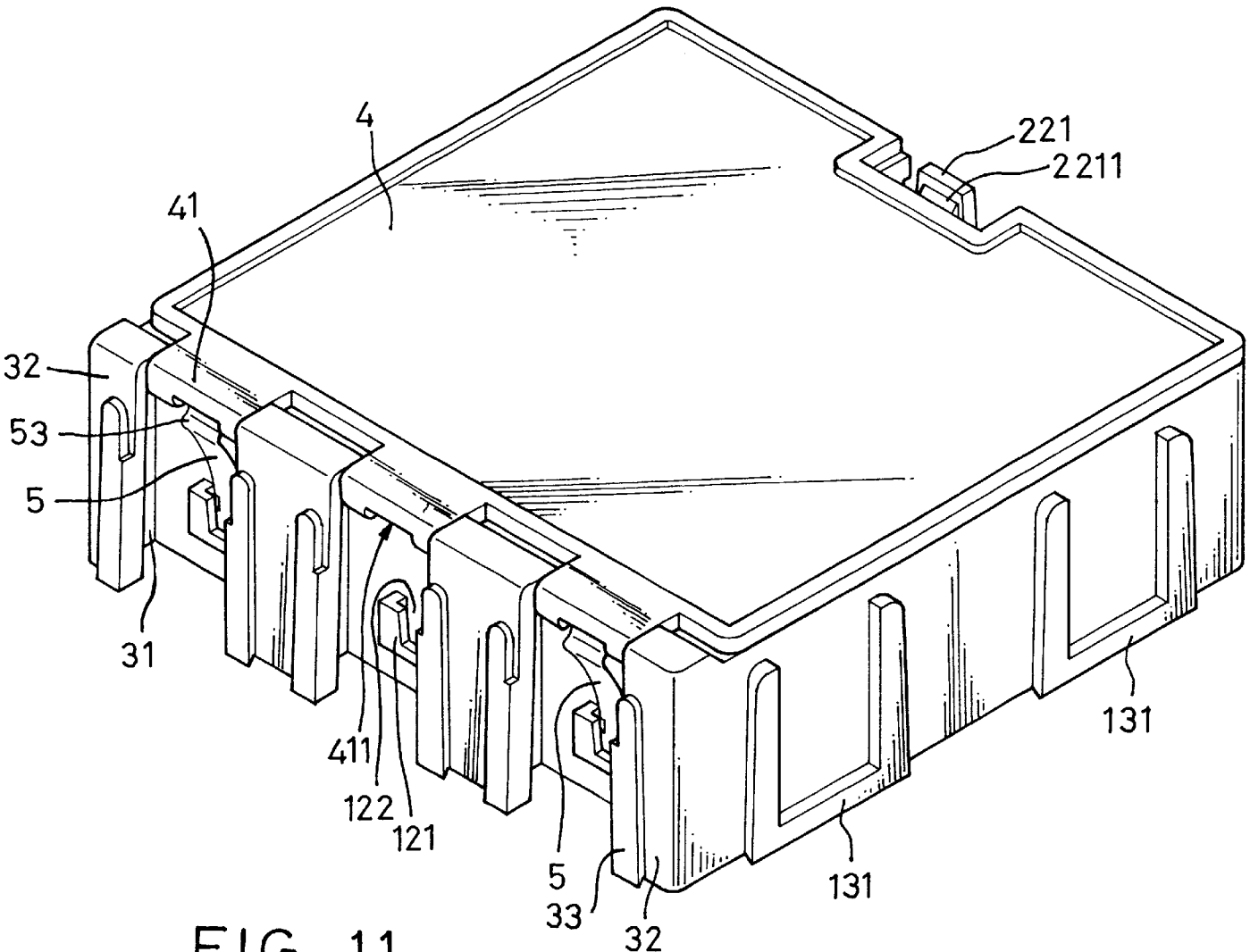
FIG. 11 is a rear perspective view of the present invention in the further embodiment thereof.

Referring to FIGS. 10 and 11, a large sized case module for big articles is illustrated. The difference of present embodiment from the preceding two embodiments is in that the left wall 13 of the case module provides at least a wall frame 131 and the right wall 14 oppositely provides the same number of wall recess 141 corresponding to the wall frame 131. Hence, when the large sized case module at the left and the right sides thereof is going to engage with the identical ones, the preceding mode can be applied too. Alternatively, the large sized case module at the left and the right sides thereof can engage with a plurality of the small case modules optionally.

Moreover, the front wall 11 of said case module at both lateral sides thereof provides at least a front recess 24 identical with the preceding wall recess 141 in addition to the front part 2 and the front recess 24 at both inner lateral sides thereof provides a front projection 241 respectively. The rear wall 12 is arranged a plurality of rear parts 3, which has the same amount as the sum of the front part 2 and the front recess 24. The upper lid 4 at the back thereof extends a respective lid plate 41 corresponding to each rear part 3 and at the bottom thereof has a lid groove 411 dented inward. In addition, the upper lid 4 at both lateral sides thereof extends a lid projection 42 respectively. Hence, when the large sized case module at the front and the rear sides thereof is going to engage with the identical ones, the preceding mode can be applied too. Alternatively, the large sized case module at the front and the rear sides thereof may engage with a plurality of the small case modules optionally.

It is appreciated that the case module of present invention is possible for the large sized ones thereof are associated with one another or the large sized ones thereof are associated with small sized ones thereof optionally. The arrangement of the present invention is helpful for a variety of parts being properly carried or placed optionally and makes the case modules constitute an orderly conjunction. Meanwhile, the upper lid of the case module can spring up easily without the need of sophisticate elastic components. These are advantages of the present invention not possible for the conventional case module to reach effectively.

While the invention has been described with reference to preferred embodiments thereof, it is to be understood that modifications or variations may be easily made without departing from the spirit of this invention, which is defined by the appended claims.

What is claimed is:

1. A case module for articles, comprising a case chamber, being a rectilinear space confined by a front wall, a rear wall, a left wall, a right wall, and a bottom wall, the left wall at an outer surface thereof forming a U-shaped wall frame protruding outward with an open top and two upright parts, a slant cut being formed between said two upright parts and the left wall, the right wall corresponding to the left wall with an outer surface thereof forming a U-shaped wall recess dented inward, the wall recess providing a width thereof corresponding to a width of the wall frame and two upright parts thereof with an outward slant cut extending outward and corresponding to the slant cut of the wall frame;

a front part, being integrally joined to an outer surface of the front wall, both lateral sides thereof providing a front post respectively, part of an upper end of the front plate being cut off to constitute an upward central engaging plate and a joint between the front post and the front plate having an outward slant cut;

a rear part, extending backward from the rear wall with both outer sides thereof having a rear post respectively to extend vertically a section of rear beam, the rear beam at the bottom thereof having a section of upward rear stick, a slant cut being formed between an outer side of the rear stick and the rear beam, the rear beam at the top thereof having an inner beam groove, the rear wall on a wall surface thereof providing a support device extending upward and inclining outward; and an upper lid, a rear side thereof extending a central lid plate and denting inward a lid groove, and extending a lid projection at both lateral sides thereof respectively;

whereby, the case module can be lifted in a state of opening by way of the lid projection being inserted between the beam groove and the case chamber and the support device being inserted into the lid cover; the case module can be in conjunction with another case module by way of the wall frame on the left wall of the case module inserting into the wall recess on the right wall of another case module to constitute a left and right connection; and the case module can be in conjunction with a further case module by way of the rear stick on the case module inserting into the front post of the further case module to constitute a front and rear connection.

2. The case module for articles according to claim 1, wherein the left wall and that of the right wall can be disposed to change to each other.

3. The case module for articles according to claim 1, wherein the front part and the rear part can be disposed to change to each other.

4. The case module for articles according to claim 1, wherein the wall recess on the right wall at both lateral sides thereof may provide an elongated wall projection respectively and a distance between the two projections is corresponding to the width of the wall frame.

5. The case module for articles according to claim 1, wherein an engaging plate of the front part at a bottom thereof provides a front projection at both lateral sides respectively and a distance between the front projection and the front post corresponds to a width of the rear post.

6. The case module for articles according to claim 1, wherein the upper lid provides a central lid hook to engage with a front projection provided at the engaging plate.

7. The case module for articles according to claim 1, wherein the support device is referred to a slant plate integrally with the rear wall and extends upward and inclines outward from the bottom thereof to inert into and locate at the lid groove.

8. The case module for articles according to claim 1, wherein the support device is referred to a projection plate, the rear wall at the outer surface thereof protrudes a wall seat and forms an engaging groove, the projection plate provides a plate end inserted into the engaging groove and the other end thereof is an insert end and a bend, and the insert end is inserted into and locating at the lid groove.

9. The case module for articles according to claim 8, wherein the plate end of the projection plate provides a respective end projection at both lateral sides thereof for inserting into the engaging groove.

10. The case module for articles according to claim 1, wherein the left wall thereof provides at least a wall frame and the right wall oppositely provides the same number of wall recess; alternatively, the front wall thereof provides at least a front recess identical with the preceding wall recess in addition to the front part in front of the front wall; the rear wall thereof is arranged a plurality of rear parts with the same amount as the sum of the front part and the front recess; and the upper lid at the back thereof extends a respective lid plate corresponding to the rear part each to form a large sized case module.

11. The case module for articles according to claim 10, wherein the large sized case module may be joined another or other identical case modules and/or a or a plurality of small sized case modules right and left, and front and rear optionally.

* * * * *